United States Patent [19]

Williams

[11] 4,449,489

[45] May 22, 1984

[54] VARYING GEOMETRIC COMPRESSION RATIO ENGINE

[76] Inventor: Gerald J. Williams, R.R. #2, Nolalu, Ontario, Canada, POT 2KO

[21] Appl. No.: 266,086

[22] Filed: May 21, 1981

[51] Int. Cl.[3] ..... F02B 75/04

[52] U.S. Cl. ..... 123/48 R; 123/41.31; 123/78 R; 123/90.16; 123/90.57; 123/169 PA

[58] Field of Search ..... 123/78 R, 78 A, 48 R, 123/48 A, 90.55, 90.57, 41.31, 169 PA, 90.46

[56] References Cited

U.S. PATENT DOCUMENTS

| | | | |
|---|---|---|---|
| 808,336 | 12/1905 | Bogert | 123/48 A |
| 1,504,101 | 8/1924 | Davidson | 123/48 A |
| 2,583,499 | 1/1952 | Teegen | 123/48 A |
| 3,728,990 | 4/1973 | Lamdredi et al. | 123/90.57 |

FOREIGN PATENT DOCUMENTS

| | | | |
|---|---|---|---|
| 826082 | 12/1951 | Fed. Rep. of Germany | 123/78 A |
| 1123521 | 2/1962 | Fed. Rep. of Germany | 123/48 A |
| 2504919 | 8/1976 | Fed. Rep. of Germany | 123/78 R |
| 770409 | 3/1957 | United Kingdom | 123/48 A |

*Primary Examiner*—William A. Cuchlinski, Jr.

[57] ABSTRACT

An automotive engine having an automatically adjusted geometric compression ratio, wherein the charge is compressed to maximum permissible values under all throttle settings. This is achieved by a cylindrical valve carrier, raised or lowered by a screw jack, while valve stem contact is maintained by a fast acting hydraulic valve actuator. The compact arrangement provides an engine profile which is not significantly taller than a standard overhead cam engine.

66 Claims, 16 Drawing Figures

B-B

C-C

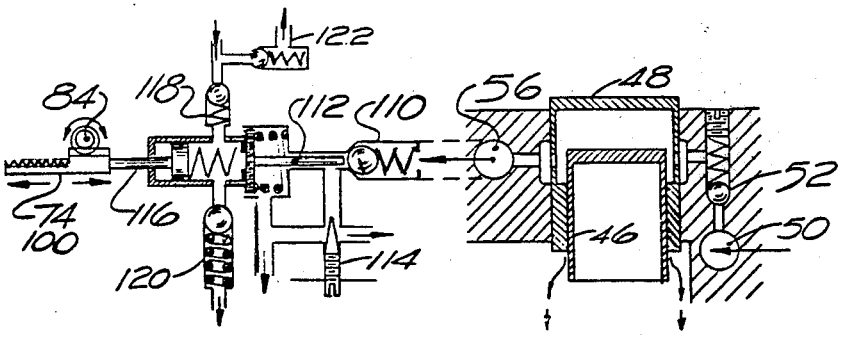
FIG. 11.
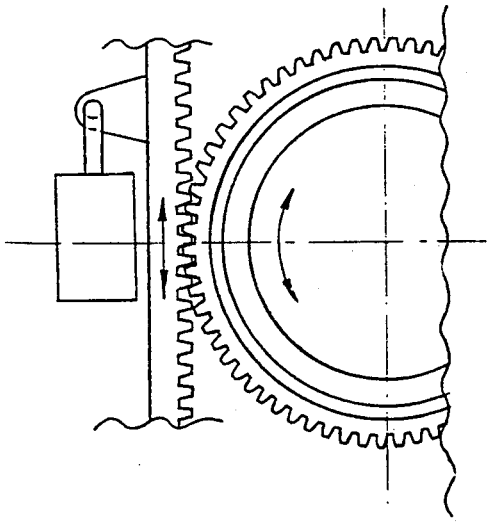
FIG. 12.
FIG. 13A.
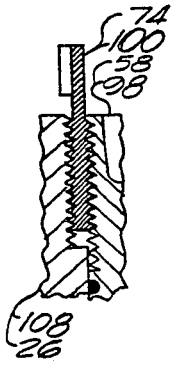
FIG. 13B.
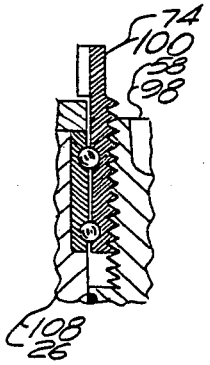
FIG. 13C.
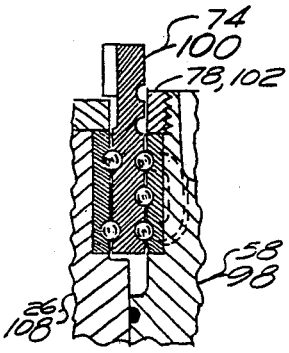

VARYING GEOMETRIC COMPRESSION RATIO ENGINE

FIELD OF THE INVENTION

This invention relates to internal combustion engines intended for constantly varying power output, such as automotive engines. More particularly the invention relates to an arrangement for an automotive engine wherein the roof of the combustion chamber is raised or lowered as determined by charge mass flow to maintain compression at constant maximum permissible values, despite variation in charge mass flow.

BACKGROUND OF THE INVENTION

It is known in the art relating to internal combustion engines that the gas charge admitted to the combustion chambers should be compressed to maximum permissible values to obtain fuel efficiency. Varying output engines as used in automobiles achieve variation in power output by regulating the gas charge mass flow. In normal engines, only under full charge mass flow is the charge compressed to maximum permissible values due to the fixed geometric compression ratio, which is designed to accommodate maximum charge mass flow. Yet most driving is done under greatly throttled conditions, resulting in fuel inefficiency under most driving conditions.

SUMMARY OF THE INVENTION

The present invention provides an engine with an automatically adjusted and constantly re-adjusted geometric compression ratio, so that the gas charge is compressed constantly to maximum values regardless of charge mass flow. That portion of the cylinder head which normally forms the roof of the combustion chamber, forms the valve ports and seats and which carries the valves, is integrated in a cylindrical valve carrier and is disposed in a concentric cylindrical valve carrier cavity, axially in line with the cylinder bore. Valve ports in the valve carrier branch laterally, and align with lateral ports in the valve carrier cavity. Conventional piston rings and other sealing means contain, and separate, combustion gasses, intake gasses and exhaust gasses. The valve carrier is raised or lowered by a screwjack in two alternative arrangements, an "internally" applied jack and an "externally" applied jack. The raising or lowering of the valve carrier effectively changes the geometric compression ratio by increasing or reducing the initial volume of the combustion chamber. A spark plug is also provided in the valve carrier. Valves are actuated by a fixed location overhead camshaft acting directly on special quick acting telescopic hydraulic valve actuators which are axially aligned with the ends of the valve stems. A high volume oil supply with externally mounted check valves ensures quick extension of the valve actuators during the raising of the valve carrier while a special hydraulic circuit ensures quick contracting during lowering of the valve carrier. The screwjack is assisted in raising the valve carrier during increases of power output by the powerful combustion pressure bias, while a decrease in combustion pressure bias during decreases of power output assists in lowering the valve carrier. The valve carrier is engine lube oil cooled. Actuation and control of the screwjacks may be provided by alternative, commercially available means. On engines provided with electronically controlled fuel injection, all the engine condition parameters which determine the injection of fuel, may be utilized to determine the geometric compression ratio required so that duplication of sensors and controls may be avoided. Conventionally these parameters are the ignition switch; the starter button; throttle position sensor; engine temperature sensor; air flow rate sensor, usually of the Jackson flap type; air temperature sensor, engine speed sensing, usually inferred from ignition coils. The jackscrew power actuation control means may be operatively connected with the power actuation means, and may define a control which will determine the gas charge mass admitted into the cylinder during each combustion cycle and which will direct the operation of the jackscrew power actuation means according to pre-programmed instructions. A fully raised valve carrier would correspond to the same geometric ratio as in a conventional engine, and would be provided during starting and full power. Power actuation of the screwjacks would be controlled by the electronic control mentioned and could be electrical, pneumatic, hydraulic or mechanical, it could utilize precision valve power actuators as used in oil refineries etc.; with both automatic control and power actuation means available from several commercial sources.

The arrangement provides a compact layout of components giving an engine profile not significantly higher than conventional modern overhead cam engines, while the invention also provides for several manufacturing economies. These and other features and advantages of the invention will be more fully understood from the following description of several preferred alternative embodiments taken together with the accompanying drawings.

BRIEF DESCRIPTION OF THE DRAWINGS

Note: Numerals are consistent for identical components used in alternative arrangements.

**Note: In FIG. 6, the longitudinal centerlines of the camshaft and the crankshaft are shown at right angles to one another in error. They are intended to be parallel.

*Reg. trademark Morse Div'n. Borg Warner Corporation

FIG. 11 is a schematic diagram of the novel hydraulic circuit which may advantageously be used to provide quick drainage of the hydraulic telescopic valve actuators during raising of the valve carrier.

FIG. 12 is a plan view of an alternative rack and spur gear power actuator for the screwjacks controlling the valve carrier. A linear hydraulic cylinder alongside the engine would take up little space and would provide quick acting, low inertia actuation of the screwjacks. Screwjacks would be provided with steep pitch multiple start threads so that the required raising and lowering would be accomplished over less than one turn. A Saginaw ball bearing screw thread is an especial advantage for steep pitch applications since its efficiency would ensure easier operation. However, it should be pointed out that the combustion bias aids raising of the valve carrier during increasing power, while decreasing bias aids lowering during a decrease in power. Hunting conditions may be avoided by slightly delaying charge admission til the geometric ratio has been adjusted relative to the power demand. This is similar in principle to the action of a vacuum slide carburetor.

FIG. 13-A shows a jackscrew with a left hand and right hand thread engaging matching threads in the cylinder head or cylinder block and in the valve carrier. Less axial travel for the jackscrew and quicker travel for the valve carrier could result depending on thread pitches chosen. FIG. 13-B shows an anti-friction bearing incorporated on the outside diameter of the jackscrew with zero axial travel for the jack screw. This improves the drive efficiency and also is useful for bevel geared jackscrew drive. FIG. 13-C shows a Saginaw ball bearing nut application for the jackscrew resulting in maximum efficiency for the jackscrew drive and valve carrier displacement.

DESCRIPTION OF THE PREFERRED EMBODIMENTS

Figure 1:
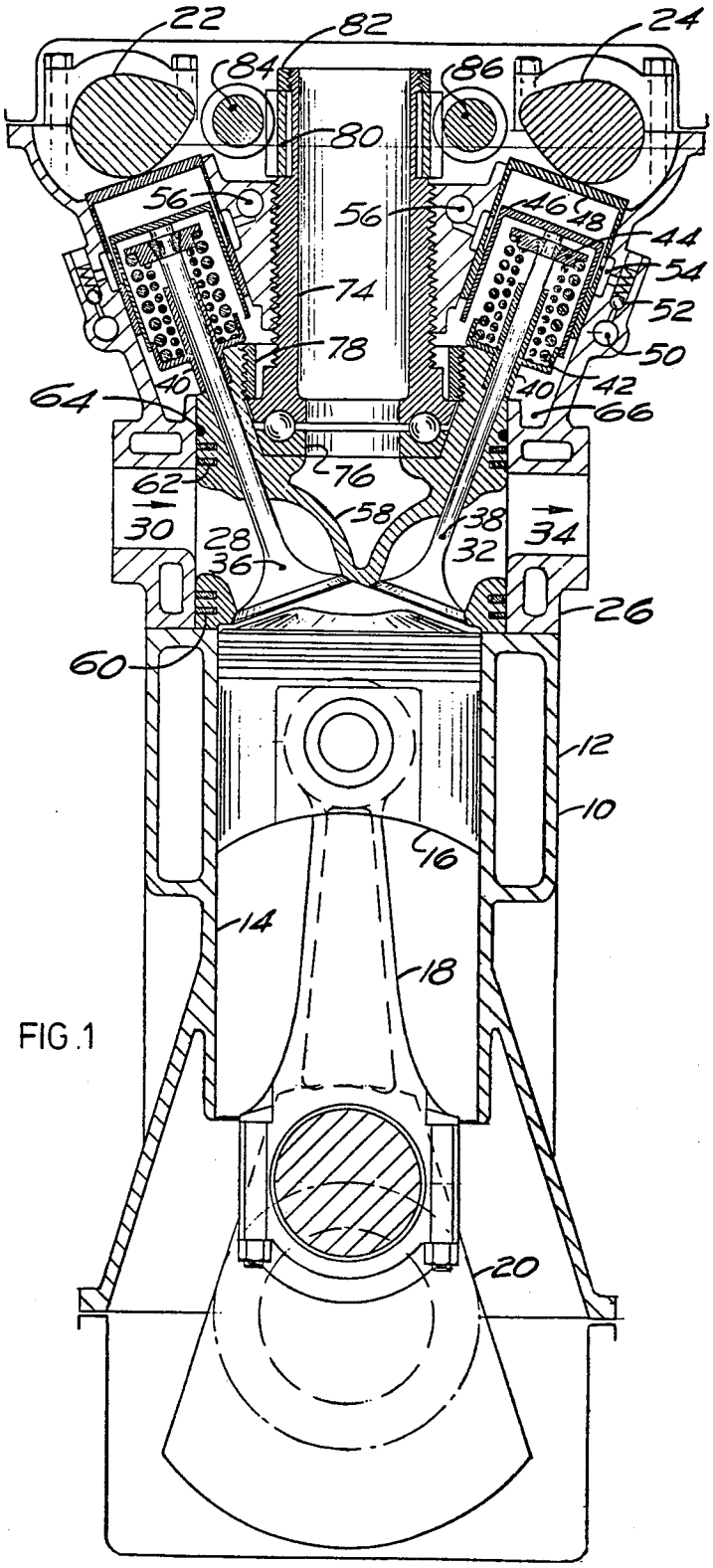
FIG. 1 is a transverse cross section of an internal combustion engine of double overhead cam variety, arranged as a first alternative in accordance with the invention, with the valve carrier of larger diameter than the piston, giving larger valve ports but increased cylinder centers, and with an "internally' arranged jackscrew. This alternative has a planar junction between cylinder block and cylinder head which is identical to convention practice and the valve carrier is carried in the cylinder head. Alternatively, the said planar junction may be raised to the top surface of the valve carrier.
Figure 3A:
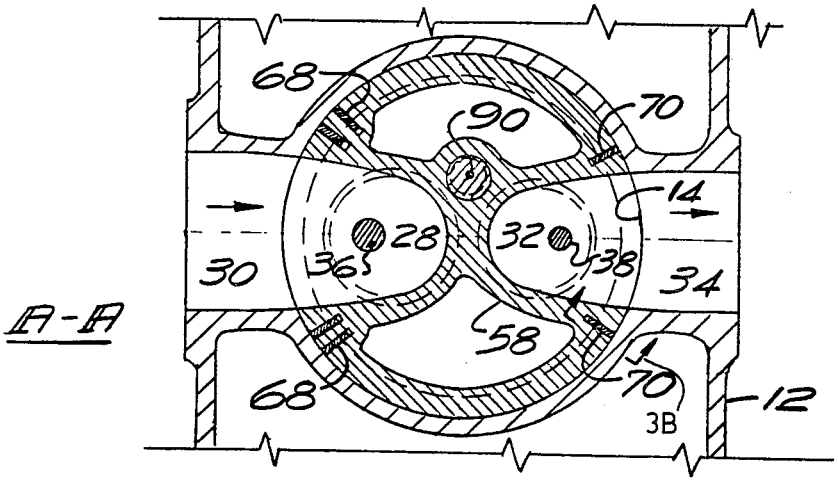
FIG. 3*a* is a fragmentary cross section taken on plane A—A in FIG. 2, and showing the gas port separation seals
Figure 3B:
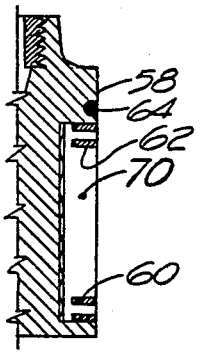
FIG. 3B is a section taken along the plane indicated in FIG. 3A.
Figure 4:
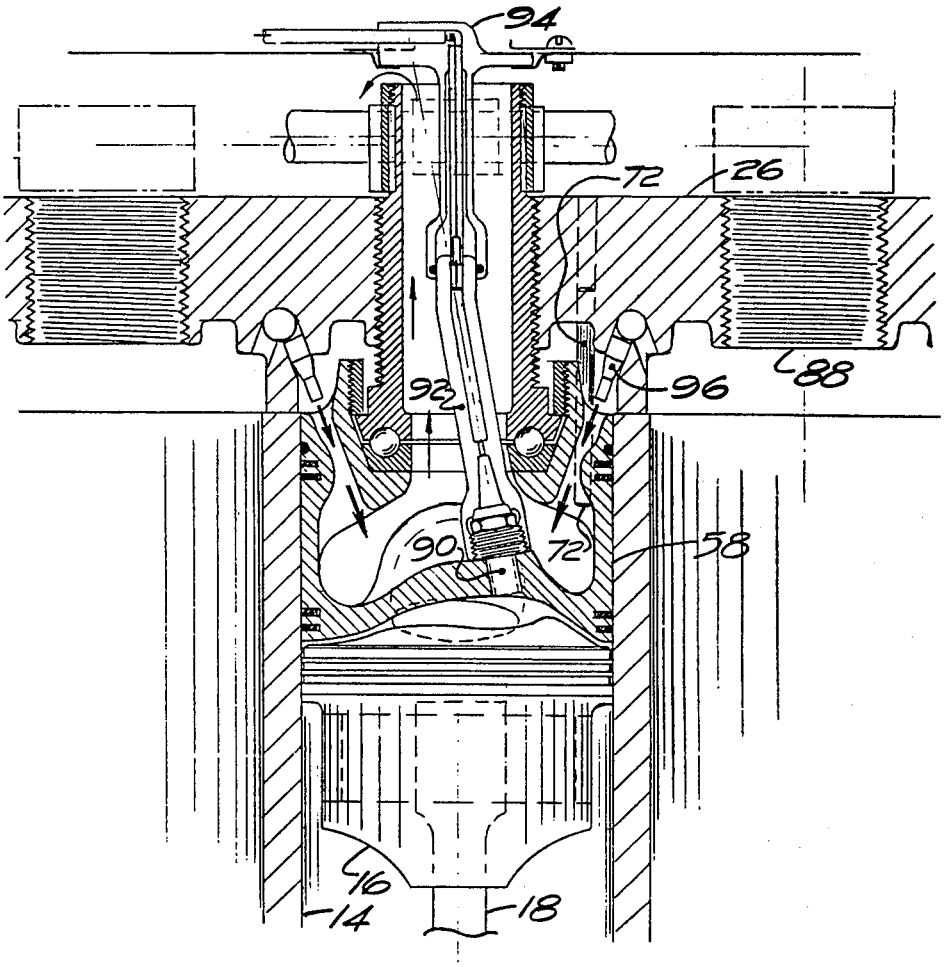
FIG. 4 is a longitudinal cross section of the engine which is shown in FIG. 2, and showing the ignition and cooling means.
Figure 10:
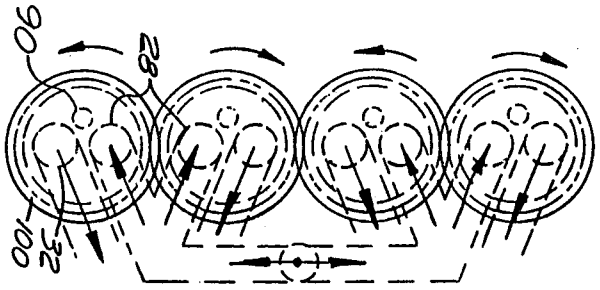
FIG. 10 is a plan view of a four cylinder engine using intermeshing straight spur gears to acuate and synchronize the jackscrews, as an alternative to the worm gear and double worms shown in the preferred embodiments. Roller chain sprockets or *Morse Hy-Vo chain sprockets may also be used to actuate and synchronize the jackscrews. Proposed manifolding of intake and exhaust gasses is also shown, giving equal length intake routes for smooth power generation, and using two left hand valve carriers and two right hand valve carriers.

Referring first to FIG. 1, there is shown a transverse cross section of an internal combustion engine indicated by numeral 10. Engine 10 includes a cylinder block 12 having longitudinally aligned cylinders 14 arranged in an in-line configuration. Pistons 16 are reciprocatably disposed in the cylinders and are operatively connected through connecting rods 18 with the crankshaft 20, rotatably supported in the cylinder block in conventional manner. Located in the upper portion of the engine are two camshafts, an intake cam shaft 22 and an exhaust cam shaft 24, both rotatably supported on an axis parallel with the axis of the crankshaft. Cylinder head 26 is mounted on top of the cylinder block on a planar junction identical to conventonal practice. Where normally the valves and valve ports are located, the cylinder head is provided with a cylindrical cavity, coaxial with the cylinders, but of larger bore. A separate cylindrical body, the valve carrier 58, closely matches the said cylindrical cavity and is disposed to reciprocate within same within limits, and thereby closes the tops of the cylinders to form combustion chambers therein. Valve carrier 58, is provided with an intake port 28, which provides communication with an externally mounted intake manifold, not shown, via a static intake port 30, by virtue of close lateral alignment. Exact lateral alignment of these ports would come about during full power output, to be subsequently explained. Generously rounded edges at the mating ends of ports 28, 30, 32, and 34 would result in minimum gas flow obstruction. Similarly exhaust port 32 provides communication with an externally mounted exhaust manifold, not shown, via static exhaust port 34. Intake valve 36 and exhaust valve 38, are conventional poppet valves and are reciprocatably disposed with their stems in valve guide holes bored in valve carrier 58, while said valves control the passage of gases between their respective ports and cylinders. The valve guide holes are bored in a common plane but on an acute angle and exit at the upper opposite outside edges of valve carrier 58. Valve spring seats 40, provided with coaxial cylindrical bottom extensions which fit in counterbored holes coaxial with the termination of the valve guide holes, provide a seat for valve springs 42. Since valve carrier 58 is installed into its cavity from below, it cannot have any surfaces protruding from its cylindrical outside surface, hence valve spring seats 40. Valve springs 42 bias the said valves in a closed position and act against valve spring retainers 44 installed with conventional valve spring keepers. A novel, high capacity, fast acting telescopic valve actuator comprises an inverted bucket shaped valve actuating piston 46 and a valve actuating cylinder 48. The cam lobes act directly against the top end face of actuating valve cylinder 48. Piston 46 is reciprocatably disposed in cylinder 48 with a precisely controlled clearance fit for the purpose of allowing oil to escape at a very slow but steady rate. A hole in the wall of valve actuating cylinder 48 communicates with a high capacity pressurized oil gallery 50 via a one way ball type check valve 52, and a circumferential oil supply groove 54. Mounting check valve 52 externally has the advantage of not having same subjected to high inertia forces, which it would be subjected to, if mounted inside valve actuating cylinder 48. And furthermore, it makes for simple and easy checking and replacement of check valve 52. It is known in the art relating to automotive maintenance that check valves in conventional hydraulic valve lifters cause most of the maintenance problems, thus easy servicing of the externally mounted check valve 52 is an advantage especially for the overhead cam arrangement of this preferred embodiment. The high capacity of the oil supply means, including the extra large high capacity check valve 52, ensures rapid extension of the telescoping valve actuator; this is required during rapid lowering of the valve carrier. During rapid raising of the valve carrier 58, the trapped oil in the telescopic valve actuators should be dumped rapidly, but at a controlled rate, to ensure that valve action is maintained properly; especially the intake valve should not be allowed to open up out of time during low bias conditions such as present during exhaust and compression strokes. A large capacity gallery, oil dumping gallery 56, leads to a special hydraulic circuit to accommodate this situation. Turning now briefly to FIG. 11, there is shown the novel hydraulic circuit controlling the rapid, but controlled, dumping of oil from gallery 56. An integrated dumping control valve is mounted to the engine block above jackscrews 74 or 100 and a dumping valve actuator piston 116 is in constant contact with the top surface of said jackscrews. Piston 116 is biased by a coil spring to maintain contact with said jackscrews, or alternatively the rod of piston 116 may be attached to the said jackscrews. During lowering of the jackscrew, piston 116 retracts and a low pressure supply of oil enters the dumping control valve through low pressure supply check valve 118. During raising of the jackscrew, the trapped oil forces dumping valve 112 of its seat, which causes a push rod on dumping valve 112 to contact the ball in dumping check valve 110, and push said ball off its seat, allowing trapped oil in dumping gallery 56 to escape at a controlled and adjustable rate by way of needle valve 114. The clearance between dumping valve rod 112 and the ball in dumping check valve 110 would be definite but very small. Dumping valve 112 is biased against its seat by a sturdy coil spring as shown, while supply pressure regulator valve 122 maintains even pressure in the dumping control valve system. All components 110, 112, 114, 116, 118, 120, 122 would be integrated into one unit. Returning now to FIG. 1, valve carrier 58, is a cylindrical casting, inserted from below into a matching cylindrical cavity in cylinder head 26. Valve carrier 58 can travel up or down within said cavity within limits. Compression sealing rings 60 seal in combustion chamber pressures while additional sealing ring 62 and elastomer seal 64 seal out oil and seal in intake port and exhaust port pressures. Turning briefly to FIG. 3 will show the additional, identical port separator seals 68 and 70, spring biased. Returning to FIG. 1, engine oil is collected in oil troughs 66 and returned to the engine sump. Turning briefly to FIG. 4, valve carrier 58 is prevented from rotating in its cavity by a locator rod 72, which is mounted solidly in valve carrier 58 and is slidably engaging a hole in cylinder head 26. Returning to FIG. 1, jackscrew 74, comprises an externally threaded cylinder with a thrust ball bearing integrated in the bottom end face; the bottom thrust race 76 of said thrust ball bearing seats solidly against a matching face in valve carrier 58. A flange on the bottom end of jackscrew 74 rotatably engages the bottom surface of jackscrew retainer ring 78, which is threaded into valve carrier 58 and is locked in place. Retainer ring 78 is adjusted carefully to eliminate all play yet allow easy rotation of the jackscrew. A worm gear 80 is splined to the top portion of jackscrew 74 with the splines allowing precision synchronization of all jackscrews in the engine. A lock nut 82 locks the worm gear 80 in place. Identical, but counter rotating worm shafts 84 and 86 run the full length of the engine and are cross connected by a pair of spur gears, not shown, and are further connected to a precision rotary actuator, not shown, of which many kinds are commercially available. These precision rotary actuators may be electrically driven and will start and stop instantly with a precision controlled pre-determined number of revolutions executed. As explained in the Brief Summary of the Invention, control of the precision rotary actuators may be advantageously originated and maintained by the same electronic control unit which controls the injection of fuel on electronic fuel injection equipped vehicles, since the parameters which control the quantity and rate of fuel injection are nearly identical to the parameters which determine the initial optimum volume of the combustion chamber. Alternatively, only one worm shaft may be employed to actuate the jackscrews. Alternatively, the worm gears 80 may be replaced by spur gears, inter meshing as shown in FIG. 10, eliminating the worm shafts 84, 86. Alternatively, the worm gears 80 may be replaced by roller chain sprockets or *Hy-Vo silent chain sprockets, both chain driven.

*Reg. trademark Morse Div'n. Borg Warner Corporation.

Alternatively, the worm gear 80 may be replaced by a spur gear, with worm shaft 84, 86, replaced by a toothed rack engaging said spur gear as illustrated in FIG. 12, and wherein a hydraulic cylinder may be advantageously placed alongside the length of the engine to power the said toothed rack. This arrangement would be more economical to produce and would be quick acting. To avoid insufficient combustion chamber volume during a rapid opening of the throttle, the engine fuel supply system, preferably electronically controlled would not supply extra charge to the intake manifold till the combustion chamber volume would be adjusted to suit. This is not an uncommon situation with vacuum slide controlled carburetored vehicles and the extremely brief lag in throttle response goes unnoticed to the average driver.

Figure 2:
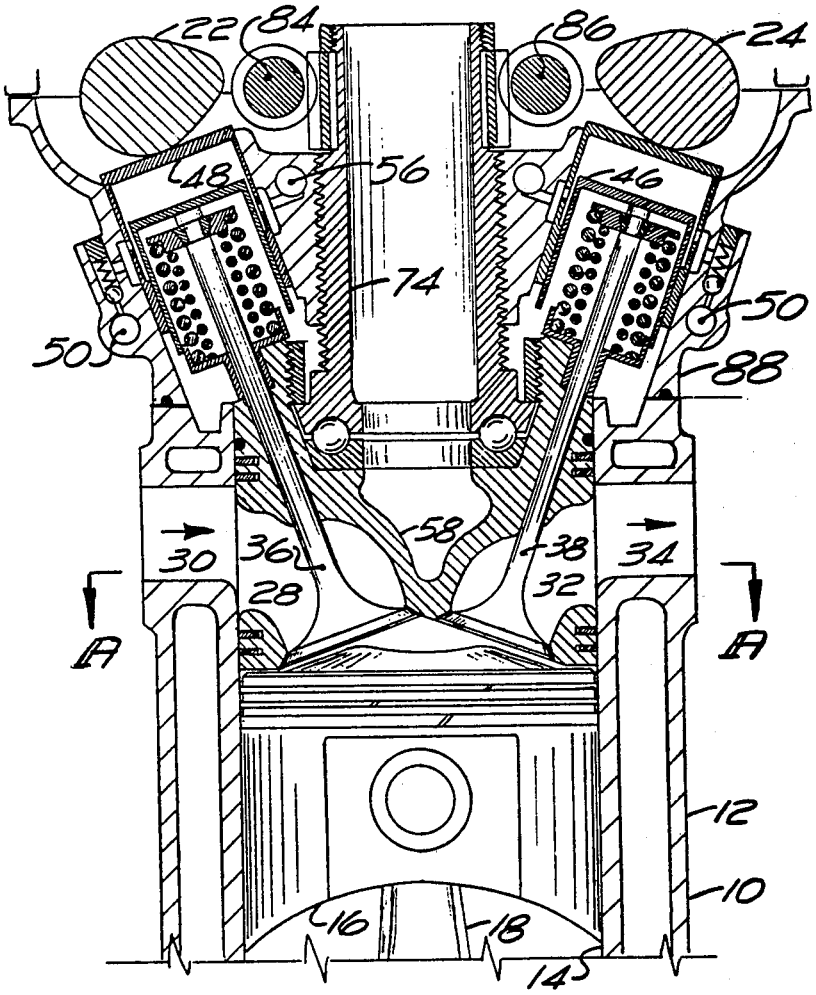
FIG. 2 is a transverse cross section similar to FIG. 1, except the valve carrier is identical in diameter to the pistons, with the planar junction between cylinder block and cylinder head located near the top of the valve carrier. This alternative avoids a special concentric cavity for the valve carrier but results in smaller valve sizes.

Turning now to FIG. 2, an alternative arrangement is shown, whereby the valve carrier 58 has an outside diameter identical to the cylinder bore and wherein the planar junction between the top of the cylinder block and the bottom of the valve head 88 is located near the top surface of the valve carrier 58. Economy of production is obvious with no special cylindrical valve carrier cavity required. A disadvantage would be slightly smaller valve sizes.

FIG. 3 shows a cross section of valve carrier 58 and shows the location of spark plug 90, and port separator seals 68 and 70, biased by corrugated ribbon springs.

FIG. 4 shows a longitudinal cross section of the engine, as illustrated in FIG. 2, and shows spark plug 90 serviced through the open bore of the jackscrew. Spark plug extension 92, an insulated, sealed molding, seals out engine cooling oil from the spark plug and angles upward to slidably contact high tension supply terminal 94 in a sealed joint. Engine oil is injected by means of cooling jet nozzles 96 into the interior cavity of the valve carrier 58.

Figure 5:
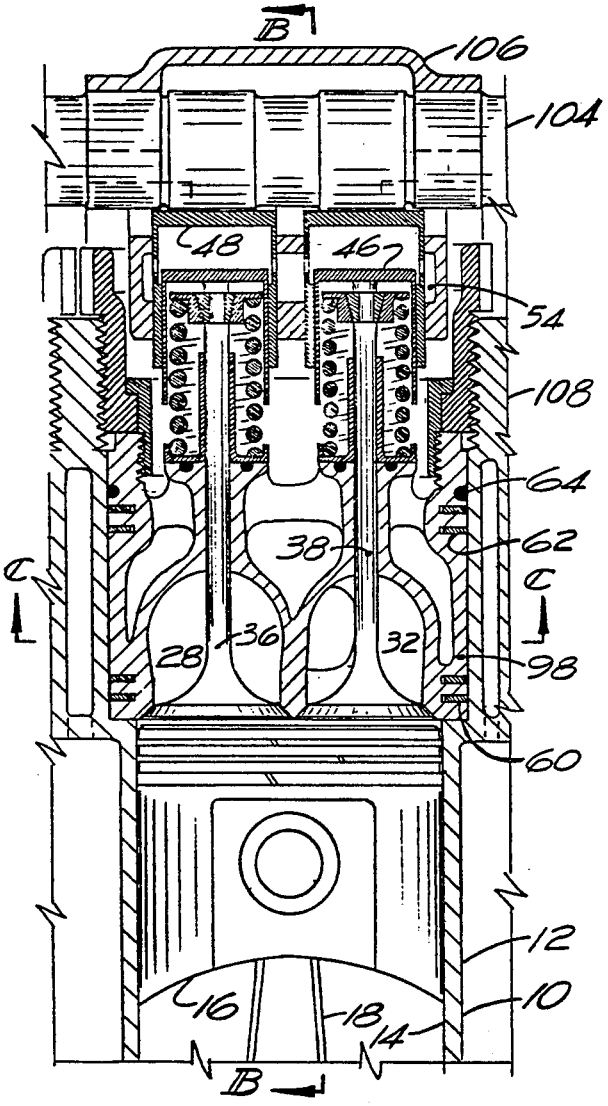
FIG. 5 is a longitudinal cross section of an engine of single overhead cam variety, arranged as a second alternative in accordance with the invention, with the valve carrier of larger diameter than the piston and with vertical valves and an "externally" arranged jackscrew. This arrangement avoids a separate cylinderhead entirely, thus providing manufacturing economies. The novel one piece housing for the camshaft and the telescopic valve actuators effects further manufacturing economies, both as aspects of the invention.
Figure 6:
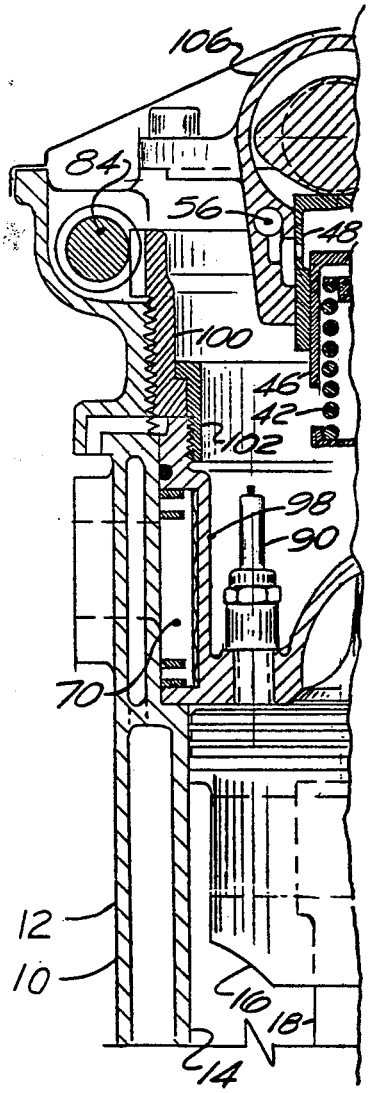
**FIG. 6 is a transverse cross section of the engine showin in FIG. 5.
Figure 7:
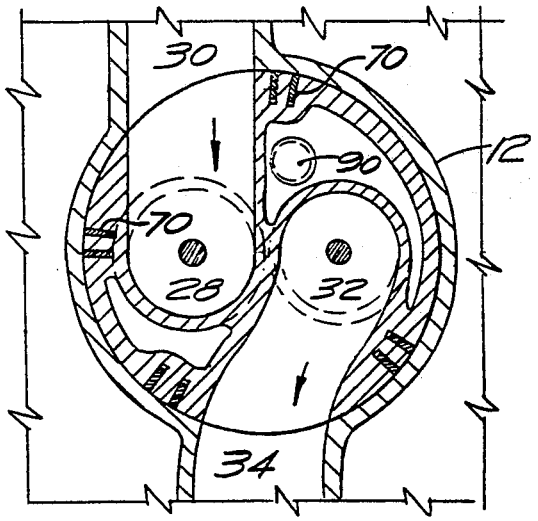
FIG. 7 is a fragmentary cross section taken on plane C—C in FIG. 5 and showing the gas port separation seals.
Figure 8:
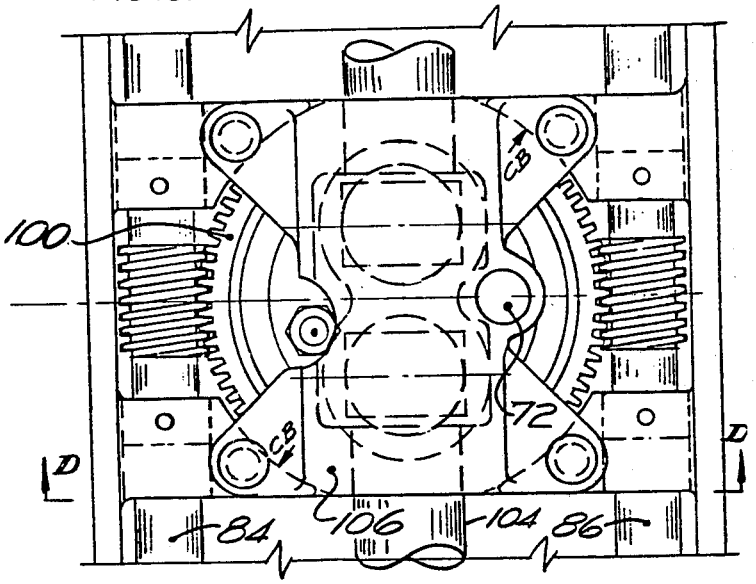
FIG. 8 is a top view of the engine shown in FIG. 5, showing the novel one piece housing for the camshaft and the telescopic valve actuators.
Figure 9:
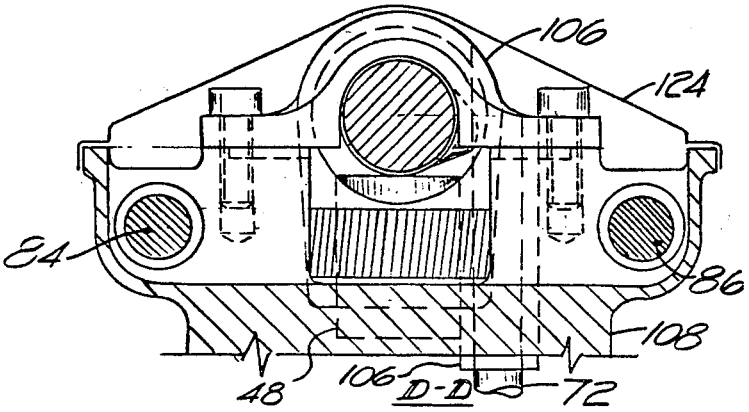
FIG. 9 is a fragmentary cross section taken on plane D—D in FIG. 8.

FIG. 5 illustrates an alternative version of the invention, with the intake and exhaust valves 36 and 38 located within the "exterior" jackscrew 100. This arrangement offers several manufacturing economies. The cylinder block 12 and cylinder head are completely integrated into one unit, integrated block 108, avoiding a costly separate casting for the cylinder head; avoiding the machining of the normal planar junction faces; avoiding cylinder head gaskets and bolts. Exterior jack screw 100 engages matching threads in the top of the integrated cylinder block and exterior jackscrew retainer 102 rotatably locks jackscrew 100 to externally actuated valve carrier 98. The single overhead camshaft 104, and the telescoping valve actuators, 46, 48, combined, are supported in a novel one piece valve actuator carrier housing 106. Normally camshafts require separate bolted bearing caps, bearing on the minor diameter; or, alternatively normally camshafts are supported in line bored bearings, bearing on major diameter journals. Novel one piece valve actuator carrier housing 106 avoids use of separate bolted bearing caps, yet allows the bearing surfaces to bear on minor diameter journals of the camshaft avoiding major diameter bearing journals on said camshaft. The camshaft 104 bears with the top surface of its minor diameter journals in matching housing bearing half journals located on both ends of housing 106; these matching housing bearing half journals straddle the said minor diameter journal, and are bifurcated or "open" on the bottom. FIGS. 8 and 9 illustrate the arrangement. The telescoping hydraulic valve actuator cylinders 48 are supported in bored baskets integrally suspended from the bottom of housing 106. The baskets and the housing half journals are integrated and supported from a half cylindrical enclosure, spanning between the half journal and with interior space sufficient to accommodate the lobes on the camshaft. In addition, the baskets are relieved on the side top edges to allow the "threading" in of the camshaft. The camshaft is installed by entering the housing 106 from one end with the first lobe down. Once the first lobe is past the first housing half journal, the cam shaft is rotated to allow the second lobe to enter. In this manner, four valve actuator carrier housings, 106, for a four cylinder engine, are "threaded" onto a camshaft; the camshaft is only supported on the bottom surface of the minor diameter journal on the ends of the camshaft; to this effect the housings, 106, which are used on the ends have one full journal on one end only. Thus the two center housings 106, would have half journals on both ends while two identical housings used on both ends of the camshaft would have full bearing journals in the outward faces only. After the front housing 106 is installed on the camshaft, a drive gear or sprocket would be mounted on said camshaft. Hydraulic valve actuator housing 106 is provided with a precision machined spigot on the bottom surface of the four mounting lugs, said spigot matching concentric locator surfaces, bored in four mounting towers integrated in the one piece integrated cylinder block and head 108. Boring operations on the cylinder block would simultaneously bore the cylinder bore, the valve carrier cavity bore, the threads for the external jackscrew 100, and the said concentric locator bored surfaces on the said four mounting towers. One planar machining operation across the top of integrated cylinder block and head 108 would provide precision mounting surfaces for housing 106 and the valve cover. Externally engaged valve carrier 98 is cooled by engine oil, injected and evacuated by positive means, while it is prevented from rotation by locator rod 72, shown in FIGS. 8 and 9, said rod slidably engaging a bored hole in valve actuator housing 106. Externally engaged valve carrier 98 may also be executed with a diameter which equals the cylinder bore.

Alternatively, the valve actuating means may be with conventional rocker arms with the camshaft located above the jackscrews, besides the jackscrews or below the jackscrews, utilizing push rod in latter case. Alternatively, in FIG. 1 the jackscrew may be reduced in diameter slightly, with one camshaft deployed on one side, actuating both intake and exhaust valves located to one side, giving more room for a sparkplug on the other side of the jackscrew. Additional useful sensors would include a combustion chamber pressure sensor reading the compression pressure by being sensitive to the range of from 0 to 300 p.s.i. and ignoring combustion pressure; a commercially available part. In the case of bevelled gear drive for the jackscrews the bevelled pinion shaft would be mounted on the valve carriers to move up and down with same.

FIG. 13-A shows a jackscrew with a left and right hand thread engaging matching threads in the cylinder head or cylinder block and in the valve carrier. Less axial travel for the jackscrew and quicker travel for the valve carrier could result depending on thread pitches chosen; applicable to both "internally" and "externally" mounted jackscrews, avoiding item 78 and 102.

FIG. 13-B shows an anti-friction bearing incorporated on the outside diameter of the jackscrew with zero axial travel for the jackscrew. This improves the drive efficiency and also is useful for bevel geared jackscrew drive; applicable to both "internally" and "externally" mounted jackscrews, avoiding item 78 and 102.

FIG. 13-C shows a Saginaw ball bearing nut application for the jackscrew resulting in maximum efficiency for the jackscrew drive and valve carrier displacement; applicable to both "internally" and "externally" mounted jackscrews. It is understood that the arrangements shown in FIG. 13 may be reversed in position.

The objects of the invention may be summarized as follows:

1. To provide an engine with an automatically and continuously on-the-run adjusting means to vary the geometric compression ratio.

2. To allow said means to be controlled in conjunction with, and controlled by, electronic fuel injection controls.

3. To allow said means to be power actuated by commercially developed and available precision metering valve actuators or hydraulic cylinder.

4. To control and vary said geometric compression ratio in a manner which will provide maximum permissible compression values at any gas mass flow rate.

5. To maintain a good combustion chamber shape in said engine while the geometric ratio varies and to carry the valving and ignition means on the said adjusting means, and to accomplish the adjusting in a positive manner despite strong combustion bias.

6. To provide said means with an "internally engaging" hollow jackscrew for engines with the valves arranged in V-configuration.

7. To provide said means with an "externally" engaging hollow jackscrew for engines with the valves arranged in parallel configuration.

8. To provide said means in easily machined cylindrical form.

9. To provide said means with alternative diameter relationships either equal to the cylinder bore or larger than the cylinder bore.

10. To provide said engine with a profile not significantly taller than normal engines of the overhead cam variety.

11. To provide a rigid location for the camshaft supported on a fixed axis.

12. To provide a self adjusting quickly re-acting valve actuating means engageable with same camshafts and the ends of the valves. To provide this valve actuating means in low profile and with hydraulic working fluid. To allow vertical as well as axial travel of the ends of the valve stems in V-configuration valves.

13. To provide said means with simple sealing means, sealing and separating gasses and engine oil.

14. To provide said means with a simple cooling means.

15. To provide said screwjacks with alternative actuating means in the form of a single or twin worm and worm gear; or alternatively in the form of a spur gear and rack; or alternatively in the form of intermeshing spur gears with a driving pinion; or alternatively with a continuous shaft with bevel pinions and bevel gears on the jackscrews; or alternatively with *Hy-Vo silent chain and matching sprockets; or alternatively with roller chain and sprockets.

16. To provide reasonably easy access to the spark plug.

17. To prevent rotation of said cylindrical form.

18. To provide a simple, dependable, hydraulic dumping valve engageable with said jackscrews.

19. To provide an integrated cylinder block and cylinder head, with simplified machining operations.

20. To provide a one piece housing supporting the camshaft journals and the valve actuators.

21. To provide alternative jackscrew to valve carrier engagement means, such as a jackscrew with LH and RH threads, a jackscrew supported on anti-friction bearing, a jackscrew incorporating a ball bearing nut.

While the invention has been disclosed by reference specific preferred embodiments it should be understood that numerous changes could be made within the scope of the inventive concepts disclosed. Accordingly, the invention is not intended to be limited by the disclosure, but rather to have the full scope permitted by the language of the following claims.

*Reg. trademark Morse Div'n Borg Warner Corporation

I claim:

1. An internal combustion engine, including geometric compression ratio varying means, comprising in combination a cylinder block having one or more cylinders in a row, a piston in each cylinder, a crankshaft rotatably supported in the cylinder block and connected with the piston or pistons to convert the reciprocating motion of same to rotational motion of the crankshaft, a cylinder head disposed on top of said cylinder bank, said cylinder head including a cylindrical valve carrier cavity, coaxial with and directly above each cylinder of the said cylinders, and communicating downwardly with said cylinder, said cylindrical valve carrier cavity defining a shallow bore in diameter approximately equal to the diameter of said cylinder and further including one lateral intake port means communicating with said cylindrical valve carrier cavity and air and fuel intake means, and lateral exhaust port means communicating with said cylindrical valve carrier cavity and an exhaust means, and further including a jackscrew support means, coaxial with and in line with each said cylindrical valve carrier cavity, one or two camshafts carried in said cylinder head for rotation on an axis parallel with the axis of the said crankshaft, said camshaft or camshafts being driven in timed relation with the movement of the piston or pistons, a valve carrier disposed in each said cylindrical valve carrier cavity, and to thereby close the top of the said cylinder, said valve carrier defining a cylindrically machined casting closely matching the said cylindrical valve carrier cavity in diameter, and reciprocatably, within limits, disposed within said cavity and prevented from rotation within same, said valve carrier including ports communicating with said cylinder and the respective said intake port means and the said exhaust port means in the said cylinder head, and poppet valves movable to control the opening and closing of said ports, said poppet valves being spring biased towards the closed position, valve actuating means between said camshaft or camshafts and said poppet valves for actuating said valves in timed relation with the motion of the piston or pistons, said valve actuating means including a means to continuously eliminate play between the lobes on said camshaft or camshafts and the ends of the stems of said poppet valves during reciprocation of said valve carrier, a jack screw, carried by said jackscrew support means and engageable with said valve carrier on a seating surface located coaxially, said jack screw defining a hollow cylinder, threaded over some length to match thread in said jack screw support means, said threads engaging so that upon rotation of said jack screw, in either direction, said jack screw will either move up or down, said jack screw also rotatably engaging said valve carrier in a manner so that upon rotation of said jack screw in either direction, within limits, said valve carrier will either move up or down within limits, said jack screw including a jack screw drive means, a jack screw power actuation means defining a means engageable with said jack screw drive means to rotate same in either direction within limits, a jack screw power actuation control means, operatively connected with said power actuation means, and defining a control which will determine the gas charge mass admitted into the cylinder or cylinders during each combustion cycle and which will direct the operation of said jack screw power actuation means according to pre-programmed instructions, an ignition means, whereby an engine is provided in which the geometric compression ratio is varied to compress the gas charge to identical or nearly identical absolute pressure values regardless of the quantity of the gas charge mass admitted during each combustion cycle, during all or most of the power output range.

2. An engine in accordance with claim 1, provided with electronic fuel injection means, and wherein said jackscrew power actuation control means is integrated with said electronic fuel injection means.

3. An engine in accordance with claim 1 wherein the said valve carrier is provided with sealing means to seal and separate combusting gasses, intake gasses and exhaust gasses, said sealing means including a number of compression sealing rings disposed in grooves located in the outside cylindrical surface of said valve carrier, below the lateral termination of said intake port means and said exhaust port means, a number of sealing rings disposed in grooves similarly located above the said lateral termination of said ports, a number of axial port separator seals, defining straight bar seals, spring biased and installed in grooves in the outside cylindrical surface of said valve carrier, said grooves being parallel to the axis of said cylindrical valve carrier and located on both sides of said lateral termination of said intake port.

4. An engine in accordance with claim 1 wherein said jackscrew includes an anti-friction thrust bearing disposed between the bottom end of said jackscrew and said valve carrier.

5. An engine in accordance with claim 1 wherein the said drive means for rotating said jackscrew includes a worm gear disposed on the top portion of said jackscrew, said worm gear engaging a worm thread on one or more worm shafts which is or are parallel with the axis of the said camshaft, said worm shaft or shafts being rotatably supported in said cylinder head and engageable with a jackscrew power actuation means.

6. An engine in accordance with claim 1 wherein the said drive means for rotating said jackscrew includes a spur gear disposed on the top portion of said jackscrew, said spur gear engaging a straight toothed rack, supported in said cylinder head and engageable with a jackscrew power actuation means.

7. An engine in accordance with claim 1 wherein the said drive means for rotating said jackscrew includes a spur gear disposed on the top portion of said jack shaft and engageable with a spur gear pinion engageable with a jackscrew power actuation means.

8. An engine in accordance with claim 1 wherein the said drive means for rotating said jackscrew includes a bevel gear disposed on the top portion of said jack shaft and engageable with a bevel gear pinion engageable with a jack screw power actuation means.

9. An engine in accordance with claim 1 wherein the said drive means for rotating said jackscrew includes a roller chain sprocket disposed on the top portion of said jack shaft and engageable with a roller chain, connecting said roller chain sprocket with a jackscrew power actuation means.

10. An engine in accordance with claim 1 wherein the said drive means for rotating said jackscrew includes a silent chain sprocket disposed on the top portion of said jack shaft and engageable with a silent chain, connecting said silent chain sprocket with a jackscrew power actuation means.

11. An engine in accordance with claim 1 wherein the said valve actuating means for each of the said valves includes a hydraulic valve actuator comprising a valve actuating cylinder, defining an inverted cylinder, closed on one end, precision machined on the inside and outside diameters and on the said end, installed invertedly over the end of the valve stem and with said end of said cylinder engaging the lobe on said camshaft directly, a valve actuating piston, defining an inverted bucket closed on one end, and precision machined on the outside diameter, to match the precision machine inside diameter of said valve actuating cylinder closely, and installed in an inverted manner in said valve actuating cylinder to define a hydraulic chamber therein, with said valve actuating piston being installed over the end of the valve stem on the said valve, within said valve actuating cylinder, with said precision machined outside diameter having an extremely small but definite clearance with the said precision machined inside diameter of said valve actuating cylinder, said clearance comprising a leakage path for oil trapped in said chamber, a valve actuating cylinder guide hole, defining a precision machined hole in a portion of said cylinder head intended to support said valve actuating cylinder, said guide hole being axially in line with said valves, an oil supply groove defining an annular groove on the inside surface of said valve actuating cylinder guide hole, an orifice in the cylinder wall of the valve actuating cylinder and providing communication between said chamber and said oil supply groove, a check valve in the supply route to said hydraulic valve actuator to prevent the trapped oil in the said chamber from escaping back into the oil supply route.

12. An engine in accordance with claim 11 wherein the said check valve is mounted externally of said valve actuating cylinder guide hole so that servicing of said check valve may be accomplished without removing said hydraulic valve actuator.

13. An engine in accordance with claim 11 wherein the oil trapped in said chamber is provided with a quick but controlled escape route, such as may be required during a rapid raising of said valve carrier, said escape route including an integrated hydraulic dumping valve comprising, a dumping valve actuator piston, defining a conventional miniature hydraulic cylinder, with one end open to form a seat, and with the piston rod end engaging the said jackscrew axially, and including an internal spring biasing said piston rod against said jackscrew, a dumping valve push rod defining a mushroom-shaped valve including a head portion and a stem portion, said head portion being seated against the open end of said miniature hydraulic cylinder to close said cylinder; said stem portion being disposed outwardly, a dumping check valve, defining a conventional check valve installed in said escape route and blocking said route, and with the said stem portion engaging the downstream end of the blocking plunger or ball in said dumping check valve in a manner so that during a displacement of said dumping valve push rod the said stem portion will unseat the said blocking plunger or ball allowing trapped oil in the hydraulic valve actuators to escape, a dumping rate needle valve defining an adjustable needle valve installed in the downstream route of any oil which has passed the dumping check valve, said needle valve controlling the rate of flow for the said oil, a low pressure supply check valve, defining a common check valve installed in a low pressure supply route leading to the said miniature hydraulic cylinder and keeping said cylinder charged with low pressure oil at all times, with said low pressure supply check valve preventing a backing up of oil into said low pressure supply route.

14. An engine in accordance with claim 1 wherein the ignition means for each cylinder is installed in the interior cavity within said valve carrier, with access to said ignition means being allowed by the hollow open interior of the said jackscrew.

15. An engine in accordance with claim 14 wherein the said ignition means includes a rigid slender cylindrical insulator, provided with an internal thread in the bottom end to match an external thread on the exterior body of the said ignition means, said insulator including an electrical conductor terminating at the top of said insulator in a sliding contact, and further including a stationary high tension supply terminal defining a rigid insulator, coaxial with the axis of jackscrew, and reaching downward inside said jackscrew to meet the said rigid slender cylindrical insulator in a slidable oil tight joint, wherein an oil tight electrical connection is made between a high voltage source and said ignition means.

16. An engine in accordance with claim 1 wherein the said valve carrier is cooled by engine lubricating oil circulated in cavities within said valve carrier.

17. An engine in accordance with claim 1 wherein the diameter of the said cylindrical valve carrier cavity is larger than the diameter of the said cylinder.

18. An engine in accordance with claim 1 wherein the said cylindrical valve carrier cavity together with the said lateral port means are omitted from said cylinder head, and are integrated in the top of the said cylinder block with the diameter of said cavity being larger than the diameter of said cylinders.

19. An engine in accordance with claim 18 wherein the diameter of the said cylindrical valve carrier cavity is equal to the diameter of said cylinders.

20. An engine in accordance to claim 1 wherein said jackscrew is provided with an external thread and an oppositely handed internal thread and wherein said valve carrier is provided with a hollow tower, coaxial with the axis of said cylinder, said tower being externally threaded to match the said internal thread on the above said jackscrew, to thereby define the said seating surface located on the axis of the said valve carrier, said threads engaging so that upon rotation of the said jackscrew in either direction, the said jackscrew and said valve carrier will move up or down respectively within limits.

21. An engine in accordance to claim 1 wherein said jackscrew is provided with an integral deep groove ball bearing around its outside diameter, including an outer race for said integral deep groove ball bearing, and wherein said jackscrew is provided with an internal thread, wherein said cylinder head is provided with a smooth bore and with an internal ledge around the inside bottom edge, wherein said valve carrier is provided with a hollow tower, coaxial with the axis of said cylinder, said tower being externally threaded to match the above said internal thread on the above said jackscrew, to thereby define the said seating surface located on the axis of the said valve carrier, wherein above said outer race for above said integral deep groove ball bearing is mounted in above said smooth bore and provided with a bearing retaining cap on its top surface to axially lock same in a fixed position in said cylinder head, wherein said internal thread of above said jackscrew engages the above said external thread of above said hollow tower, and wherein rotation of above said jackscrew in either direction will move the above said valve carrier up or down respectively within limits.

22. An engine in accordance to claim 21 wherein said jackscrew is not provided with an internal, but instead is provided with an internal helical groove to provide a raceway for balls, said jackscrew being provided with an internal ball bearing nut, grooved to match the above said helical groove, and including a complement of balls to fit said grooves, and ball recirculator means, wherein said hollow tower is not externally threaded, but instead is machined smoothly with an outside diameter to match the inside diameter of said ball bearing nut, wherein said ball bearing nut is mounted securely on, said locked to, said hollow tower, and wherein rotation of above said jackscrew in either direction will move the above said valve carrier up or down respectively within limits.

23. An engine in accordance with claim 21, wherein the position of said integral deep groove ball bearing and said internal thread on said jackscrew is reversed, so that the said integral deep groove ball bearing is provided on the inside of said jackscrew and the said internal thread is instead an external thread on said jackscrew, and wherein said cylinder head and said valve carrier are modified to accommodate the above said reversal of positions, whereby a reversed arrangement is provided.

24. An engine in accordance to claim 22, wherein the position of, said integral deep groove ball bearing, said internal helical groove, said ball bearing nut on said jack screw, is reversed, from outside to inside, and vice versa, and wherein said cylinder head and said valve carrier are modified to accommodate the above said reversal of positions, whereby a reversed arrangement is provided.

25. An internal combustion engine, including geometric compression ratio varying means, comprising in combination a cylinder block, having one or more cylinders in a row with each cylinder defining three coaxial, stacked bores, a first bore, located in the bottom portion of said cylinder and defining cylinder walls to support the reciprocating motion of a piston, a second bore located directly above said first bore, a third bore located above said second bore, and wherein said intake port means communicates laterally with said second bore and an intake manifold, and said exhaust port means communicates laterally with said second bore and an exhaust manifold, a piston disposed in each of the said first bores in each of the cylinders, a crankshaft rotatably supported in the cylinder block and connected with the piston or pistons to convert the reciprocating motion of same to rotational motion of the crankshaft, a valve carrier, reciprocatably, within limits, disposed in each said second bore in each said cylinder, to thereby close the top end of each said cylinder, said valve carrier defining a cylindrically machined casting, closely matching the said second bore in diameter, and prevented from rotating within said second bore, said valve carrier including ports communicating with said cylinder and the respective said intake port means and the respective said exhaust port means in the said second bore in each said cylinder, and including poppet valves movable to control the opening and closing of said port means, said poppet valves being spring biased towards the closed position, one or more camshafts carried by said cylinder block for rotation on an axis parallel with the axis of said crankshaft, said camshaft or camshafts being driven in timed relation with the movement of the piston or pistons, valve actuating means between said camshaft or camshafts and said poppet valves for actuating said valves in timed relation with the motion of said piston or pistons said actuating means including a means to continuously eliminate play between the lobes on said camshaft or camshafts and the ends of the stems of said poppet valves during reciprocation of said valve carrier, a jackscrew support means defining a coaxial and threaded cylindrical means disposed in said third bore in said cylinder, a jackscrew rotatably disposed within each said third bore in each said cylinder, said jackscrew defining a hollow cylinder threaded over some length to match said jackscrew support means, said jackscrew engaging said support means in a manner so that upon rotation of said jackscrew in either direction, said jackscrew will either move up or down, said jackscrew also rotatably engaging said valve carrier in a manner so that upon rotation of said jackscrew in either direction, within limits, said valve carrier will either move up or down within limits, said jackscrew including a jackscrew drive means, a jackscrew power actuation means defining a means engageable with said jackscrew drive means to rotate same in either direction within limits, a jackscrew power actuation control means, operatively connected with said power actuation means, and defining a control which will determine the gas charge mass admitted into the cylinder or cylinders during each combustion cycle and which will direct the said jackscrew power actuation means according to pre-programmed instructions, an ignition means, whereby an engine is provided in which geometric compression ratio is varied to compress the gas charge to identical or nearly identical absolute pressure values regardless of the quantity of gas charge mass admitted during each combustion cycle, during all or most of the power output range.

26. An engine in accordance to claim 25 in which the said cylinder block includes integral cast and machined raised protruberances located above the top end of said third bore in each said cylinder, said raised protruberances having a machined surface on a common flat plane to provide a bearing or support surface for a cast and machined housing which provides support for said camshaft or camshafts and said valve actuating means, a valve cover, closing the top of said engine whereby an engine is provided with reduced manufacturing operations.

27. An engine in accordance to claim 26 including one or more one piece valve actuation carrier and camshaft support housings defining a machined casting comprising a semi-circular roof, coaxial with the axis of said camshaft and covering an intake lobe and an adjacent exhaust lobe on said cam shaft, a semi-circular bearing, above the axis of said camshaft, coaxial with the axis of said camshaft, matching the minor diameter bearing journals on said camshaft, and disposed on each end of said semi-circular roof, two adjacent valve actuator support baskets, defining two adjacent basket-like supports suspended downwardly from the bottom edges of said semi-circular roof, co-planar with the axis of said camshaft, with each said basket bored to support a cylindrical valve actuator, four support lugs, located on a flat plane square with the axis of said valve actuator support baskets, with one of said support lugs located each side of each of said semi-circular bearings, a shallow locating spigot, defining a shallow dropped cylindrical surface on the bottom machined surface of each of the said support lugs, said locating spigot being coaxial with said cylinder and matching a shallow coaxial locating bore machined in said cast and machined raised protruberances, where an engine is provided with reduced manufacturing operations.

28. An engine in accordance to claim 27 wherein two of the said one piece valve actuator carrier and camshaft support housings are modified to include one full circular bearing on the outward end only of each said housings, said full circular bearing being coaxial with the axis of the said camshaft and matching the minor diameter bearing journals on said camshaft, whereby said camshaft is provided with 360 degree support during rotation at both outward ends of said camshaft, said 360 degree support being provided solely by said modified support housings, whereby an engine is provided which does not require line boring of the cylinder block or cylinder head for support of the camshaft.

29. An engine in accordance to claim 27 wherein said one piece valve actuation carrier and camshaft support housings exclude said shallow locating spigot, and wherein said four support lugs are cylindrically machined on the outside vertical edges, co-axial with the axis of the said cylinder, with the cylindrically machined surfaces matching cylindrically machined surfaces on said cast and machined raised protuberances.

30. An engine in accordance to claim 29 wherein said cylindrically machined surfaces on said four support lugs are omitted.

31. An engine in accordance with claim 25, provided with electronic fuel injection means, and wherein said jackscrew power actuation control means is integrated with said electronic fuel injection means.

32. An engine in accordance with claim 25, wherein the said valve carrier is provided with sealing means to seal and separate combusting gasses, intake gasses and exhaust gases, said sealing means including a number of compression sealing rings disposed in grooves located in the outside cylindrical surface of said valve carrier, below the lateral termination of said intake port means and said exhaust port means, a number of sealing rings disposed in grooves similarly located above the said lateral termination of said portss, a number of axial port separator seals, defining straight bar seals, spring biased and installed in grooves in the outside cylindrical surface of said valve carrier, said grooves being parallel to the axis of said cylindrical valve carrier and located on both sides of said lateral termination of said intake port, or ports.

33. An engine in accordance with claim 25 wherein said jackscrew include an anti-friction thrust bearing disposed between the bottom end of said jackscrew and said valve carrier.

34. An engine in accordance with claim 25 wherein the said drive means for rotating said jackscrew includes a worm gear disposed on the top portion of said jackscrew, said worm gear engaging a worm thread on one or more worm shafts which is or are parallel with the axis of the said camshaft, said worm shaft or shafts being rotatably supported in said cylinder head and engageable with a jackscrew power actuation means.

35. An engine in accordance with claim 25 wherein the said drive means for rotating said jackscrew includes a spur gear disposed on the top portion of said jackscrew, said spur gear engaging a straight toothed rack, supported in said cylinder head and engageable with a jackscrew power actuation means.

36. An engine in accordance with claim 25 wherein the said drive means for rotating said jackscrew includes a spur gear disposed on the top portion of said jack shaft and engageable with a spur gear pinion engageable with a jackscrew power actuation means.

37. An engine in accordance with claim 25 wherein the said drive means for rotating said jackscrew includes a bevel gear disposed on the top portion of said jack shaft and engageable with a bevel gear pinion engageable with a jack screw power, actuation means.

38. An engine in accordance with claim 25 wherein the said drive means for rotating said jackscrew includes a roller chain sprocket disposed on the top portion of said jack shaft and engageable with a roller chain, connecting said roller chain sprocket with a jackscrew power actuation means.

39. An engine in accordance with claim 25 wherein the said drive means for rotating said jackscrew includes a silent chain sprocket disposed on the top portion of said jack shaft and engageable with a silent chain, connecting said silent chain sprocket with a jackscrew power actuation means.

40. An engine in accordance with claim 25 wherein the said valve actuating means for each of the said valves includes a hydraulic valve actuator comprising a valve actuating cylinder, defining an inverted cylinder, closed on one end, precision machined on the inside and outside diameters and on the said end, installed invertedly over the end of the valve stem and with said end of said cylinder engaging the lobe on said camshaft directly, a valve actuating piston, defining an inverted bucket closed on one end, and precision machined on the outside diameter, to match the precision machined inside diameter of said valve actuating cylinder closely, and installed in an inverted manner in said valve actuating cylinder to define a hydraulic chamber therein, with said valve actuating piston being installed over the end of the valve stem on the said valve, within said valve actuating cylinder, with said precision machined outside diameter having an extremely small but definite clearance with the said precision machined inside diameter of said valve actuating cylinder, said clearance comprising a leakage path for oil trapped in said chamber, a valve actuating cylinder guide hole, defining a precision machined hole in a portion of said cylinder head intended to support said valve actuating cylinder, said guide hole being axially in line with said valves, an oil supply groove defining an annular groove on the inside surface of said valve actuating cylinder guide hole, an orifice in the cylinder wall of the valve actuating cylinder and providing communication between said chamber and said oil supply groove, a check valve in the supply route to said hydraulic valve actuator to prevent the trapped oil in the said chamber from escaping back into the oil supply route.

41. An engine in accordance with claim 40 wherein the oil trapped in said chamber is provided with a quick but controlled escape route, such as may be required during a rapid raising of said valve carrier, said escape route including an integrated hydraulic dumping valve comprising, a dumping valve actuator piston, defining a conventional miniature hydraulic cylinder, with one end open to form a seat, and with the piston rod and engaging the said jackscrew axially, and including an internal spring biasing said piston rod against said jackscrew, a dumping valve push rod defining a mushroom-shaped valve including a head portion and a stem portion, said head portion being seated against the open end of said miniature hydraulic cylinder to close said cylinder, said stem portion being disposed outwardly, a dumping check valve, defining a conventional check valve installed in said escape route and blocking said route, and with the said stem portion engaging the downstream end of the blocking plunger or ball in said dumping check valve in a manner so that during a displacement of said dumping valve push rod the said stem portion will unseat the said blocking plunger or ball allowing trapped oil in the hydraulic valve actuators to escape, a dumping rate needle valve defining an adjustable needle valve installed in the downstream route of any oil which has passed the dumping check valve, said neele valve controlling the rate of flow for the said oil, a low pressure supply check valve, defining a common check valve installed in a low pressure supply route leading to the said miniature hydraulic cylinder and keeping said cylinder charged with low pressure oil at all times, with said low pressure supply check valve preventing a backing up of oil into said low pressure supply route.

42. An engine in accordance with claim 40 wherein the said check valve is mounted externally of said valve actuating cylinder guide hole so that servicing of said check valve may be accomplished without removing said hydraulic valve actuator.

43. An engine in accordance with claim 25 wherein the ignition means for each cylinder is installed in the interior cavity within said valve carrier, with access to said ignition means being allowed by the hollow open interior of the said jackscrew.

44. An engine in accordance with claim 25 wherein the said valve carrier is cooled by engine lubricating oil circulated in cavities within said valve carrier.

45. An engine in accordance with claim 25 wherein the said second bore is equal in diameter to the said first bore.

46. An engine in accordance to claim 21, wherein said jackscrew is provided with an external thread and an oppositely handed internal thread and wherein said valve carrier is provided with a hollow tower, coaxial with the axis of said cylinder, said tower being externally threaded to match the said internal thread on the above said jackscrew, said threads engaging so that upon rotation of the said jackscrew in either direction, the said jackscrew and said valve carrier will move up or down respectively within limits.

47. An engine in accordance to claim 25, wherein said jackscrew is not threaded but is provided with an integral deep groove ball bearing around its outside diameter, including an outer race for said integral deep groove ball bearing, and wherein said jackscrew is provided with an internal thread, wherein said third bore is provided with an internal ledge around the inside bottom edge, wherein said valve carrier is provided with a hollow tower, coaxial with the axis of said cylinder, said tower being externally threaded to match the above said internal thread on the above said jackscrew, wherein above said outer race for above said integral deep groove ball bearing is mounted in above said third bore and provided with a bearing retaining cap on its top surface to axially lock same in a fixed position in said cylinder block, wherein above said internal thread of above said jackscrew engages the above said external thread of above said hollow tower, and wherein rotation of above said jackscrew in either direction will move the above said valve carrier up or down respectively within limits.

48. An engine in accordance to claim 47 wherein said jackscrew is not provided with an internal, but instead is provided with an internal helical groove to provide a raceway for balls, said jackscrew being provided with an internal ball bearing nut, grooved to match the above said helical groove, and including a complement of balls to fit said grooves, and ball recirculator means, wherein said hollow tower is not externally threaded, but instead is machined smoothly with an outside diameter to match the inside diameter of said ball bearing nut, wherein said ball bearing nut is mounted securely on, and locked to, said hollow tower, wherein rotation of above said jackscrew in either direction will move the above said valve carrier up or down respectively within limits.

49. An engine in accordance to claim 48, wherein the position of, said integral deep groove ball bearing, said internal helical groove, said ball bearing nut on said jack screw, is reversed, from outside to inside, and vice versa, and wherein said cylinder block and said valve carrier are modified to accommodate the above said reversal of positions, whereby a reversed arrangement is provided.

50. An engine in accordance to claim 47, wherein the position of said integral deep groove ball bearing and said internal thread on said jackscrew is reversed, so that the said integral deep groove ball bearing is provided on the inside of said jackscrew and the said internal thread is instead an external thread on said jackscrew, and wherein said cylinder block and said valve carrier are modified to accommodate the above said reversal of positions, whereby a reversed arrangement is provided.

51. In an internal combustion engine of the type having means defining a piston, reciprocatably disposed in a cylinder, and defined in upward direction by a combustion chamber roof, and wherein the geometric compression ratio is varied by raising or lowering said combustion chamber roof relative to the top dead center position of said piston, and the improvement comprising a jackscrew means to vary said geometric compression ratio, said jackscrew means defining a helically threaded means, disposed coaxially with the axis of the cylinder, in an overhead position, said helically threaded means acting on said combustion chamber roof, in axial direction, whereby rotation of said helically threaded means, within limits in either direction results in said raising or lowering of said combustion chamber roof within limits, to thereby vary the geometric compression ratio, an actuation means, to rotate said helically threaded means in either direction, within limits, a control means, to control said actuation means in relationship with the mass of the charge about to be induced in said combustion chamber said actuation means including a gear coaxially mounted on said helically threaded means and a driven cooperating member in engagement with said gear for driving thereof.

52. In an engine according to claim 51, wherein said gear is a worm gear, and said driven cooperating member is a mating right angle worm shaft.

53. In an engine according to claim 51, wherein said gear is a spur gear, and said driven cooperating member is a mating pinion gear.

54. In an engine according to claim 51, wherein said driven cooperating member is a toothed rack.

55. In an engine according to claim 54, wherein said actuating means comprises a hydraulic cylinder, operatively connected to said toothed rack.

56. In an engine according to claim 51, wherein said gear is a bevel gear, and said driven coperating member is a mating bevel pinion.

57. In an engine according to claim 51, wherein said rotation of said helically threaded means is carried out by a spur gear, coaxially mounted on said means, said spur gear engaging and meshing with the spur gear of the adjacent cylinder and wherein said means of said first cylinder is threaded opposite in direction to said means of said adjacent cylinder.

58. In an engine according to claim 51, wherein ignition is accomplished by an ignitor carried by a valve carrier, said ignitor accessible by way of a hollow interior of said helically threaded means.

59. In an engine according to claim 51, wherein said engine is provided with electronic fuel injection means and wherein said control means comprises an electronic control means integrated with said electronic fuel injection means.

60. In an internal combustion engine of the type having means defining a piston, reciprocatably disposed in a cylinder, and defined in upward direction by a combustion chamber roof, and wherein the geometric compression ratio is varied by raising or lowering said combustion chamber roof relative to the top dead center position of said piston, and the improvement comprising a jackscrew means to vary said geometric compression ratio, said jackscrew means defining a helically threaded means, disposed coaxially with the axis of the cylinder, in an overhead position, said helically threaded means acting on said combustion chamber roof, in axial direction, whereby rotation of said helically threaded means, within limits in either direction results in said raising or lowering of said combustion chamber roof within limits, to thereby vary the geometric compression ratio, an actuation means, to rotate said helically threaded means in either direction, within limits, a control means, to control said actuation means in relationship with the mass of the charge about to be induced in said combustion chamber and wherein said means forming the roof of the combustion chamber comprises a cylindrical valve carrier means defining a coaxial bore above said top dead center position of said piston said bore provided with lateral aspiration port means, a cylindrical valve carrier comprising a cylindrical casting, reciprocatably disposed in said coaxial bore, to thereby form said roof of said combustion chamber, said valve carrier provided with valve ports, communicating with said combustion chamber and said lateral aspiration port means and valves to control the opening or closing of said valve ports in timed relation with the position of said piston.

61. In an engine according to claim 60, wherein said valves are arranged in a splayed V-layout and wherein said helically threaded means is disposed in the crotch between said valves.

62. In an engine according to claim 60, wherein said valves are arranged in a vertical, approximately parallel layout, and wherein said helically threaded means is disposed annularly around protruding top extremities of said valves.

63. In an engine according to claim 60, wherein said valve carrier is cooled by forced circulation of engine lubricating oil, though cavities in said valve carrier.

64. The engine according to claim 60, wherein said engine is provided with electronic fuel injection means and wherein said control means comprises and electronic control means integrated with said electronic fuel injection means.

65. In an internal combustion engine of the type having means defining a piston, reciprocatably disposed in a cylinder, and defined in upward direction by a combustion chamber roof, and wherein the geometric compression ratio is varied by raising or lowering said combustion chamber roof relative to the top dead center position of said piston, and the improvement comprising a jackscrew means to vary said geometric compression ratio, said jackscrew means defining a helically threaded means, disposed coaxially with the axis of the cylinder, in an overhead position, said helically threaded means acting on said combustion chamber roof, in axial direction, whereby rotation of said helically threaded means, within limits in either direction results in said raising or lowering of said combustion chamber roof within limits, to thereby vary the geometric compression ratio, an actuation means, to rotate said helically threaded means in either direction, within limits, a control means, to control said actuation means in relationship with the mass of the charge about to be induced in said combustion chamber and wherein said rotation of said helically threaded means is carried out by a chain sprocket, coaxially mounted on said means and a chain.

66. In an internal combustion engine of the type having means defining a piston, reciprocatably disposed in a cylinder, and defined in upward direction by a combustion chamber roof, and wherein the geometric compression ratio is varied by raising or lowering said combustion chamber roof relative to the top dead center position of said piston, and the improvement comprising a jackscrew means to vary said geometric compression ratio, said jackscrew means defining a helically threaded means, disposed coaxially with the axis of the cylinder, in an overhead position, said helically threaded means acting on said combustion chamber roof, in axial direction, whereby rotation of said helically threaded means, within limits in either direction results in said raising or lowering of said combustion chamber roof within limits, to thereby vary the geometric compression ratio, an actuation means, to rotate said helically threaded means in either direction, within limits, a control means, to control said actuation means in relationship with the mass of the charge about to be induced in said combustion chamber and wherein said actuation means comprises an electrical motor, operatively connected.

* * * * *